United States Patent [19]

Lytle

[11] Patent Number: 4,846,734

[45] Date of Patent: Jul. 11, 1989

[54] VERTICAL EDGE CARD CONNECTORS

[75] Inventor: Thomas G. Lytle, Danbury, Conn.

[73] Assignee: Burndy Corporation, Norwalk, Conn.

[21] Appl. No.: 146,858

[22] Filed: Jan. 22, 1988

[51] Int. Cl.[4] ..... H01R 13/26; H01R 9/09

[52] U.S. Cl. ..... 439/637; 439/816

[58] Field of Search ..... 439/629, 630, 631–637, 439/816

[56] References Cited

U.S. PATENT DOCUMENTS

| | | | |
|---|---|---|---|
| 4,077,694 | 3/1978 | Cobaugh et al. | 439/633 |
| 4,166,667 | 9/1979 | Griffin | 439/634 X |
| 4,184,735 | 1/1980 | Ammon et al. | 439/637 |

*Primary Examiner*—William L. Sikes
*Assistant Examiner*—Phan T. Heartney
*Attorney, Agent, or Firm*—Perman & Green

[57] ABSTRACT

A connector adapted to be attached to a mother printed circuit board and to removably receive a daughter printed circuit board of the edge card type and adapted to mechanically and electrically couple the mother and daughter printed circuit boards, the connector comprising an electrically insulating housing; and a plurality of electrically conductive contacts extending through the housing in rows of spaced pairs for removably receiving an edge of a daughter printed circuit board in a central plane between the rows, each contact including a lower section formed as a solder tail positionable to depend from the housing for coupling with the mother printed circuit board; an intermediate section extending upwardly from the solder tail and inwardly toward the central plane for supporting a received daughter printed circuit board; and an upper section extending upwardly and outwardly to define, at the bight of the upper and intermediate sections, a contact area of compound radii configuration on the radially exterior face of the bight bowed outwardly with respect to the radially interior face of the bight, with the contact area of each pair of contacts facing toward each other for contacting the traces on the edge of a received daughter printed circuit board. Also disclosed is the method of fabricating such connectors by coining and bending.

15 Claims, 4 Drawing Sheets

VERTICAL EDGE CARD CONNECTORS

BACKGROUND OF THE INVENTION

1. Field of the Invention

This invention relates to electrical connectors and, more particularly, to electrical contacts in connectors, each contact having a bend and a coined area on the exterior face of the bend for effecting contact with an electrical component.

2. Description of the Background Art

In the electrical arts it is a common practice to use a connector to mechanically and electrically couple a mother printed circuit board with a daughter printed circuit board as of the vertical edge card variety. In such a practice, there has been an evolution towards placing electrical contacts closer and closer together while maintaining a high, constant stress between the electrical contacts and the areas to be contacted. In placing the contacts closer together, as to 20 contacts per linear inch, the width of each contact must decrease. This, in turn, makes it much more difficult to keep the proper contact stress between the contact and the areas to be contacted while also assuring proper alignment between the two upon insertion of the edge card into the connector. One approach in the past was to apply a spherical dimple stampled into the contact.

In the past, there have been used connector contacts with dimples and without dimples. In addition, crowns have been placed on certain types of larger contacts as by the coining process. Also in the past, a wide variety of materials have been used as contacts and a wide variety of techniques have been used for assembling the contacts into the housing for pre-stressing purposes. Nowhere in the prior art, however, is there a connector with contacts of the reduced sizes and with the increased, constant stresses to achieve the performance as described and claimed herein.

Although many prior advances are noteworthy to one extent or another, none achieves the objective of an effective, efficient and economical connector with contacts, each having a coined bend and a contact area formed of compound radii.

As illustrated by a great number of prior patents as well as commercial devices, efforts are continuously being made in an attempt to improve connectors and their contacts to render them more efficient, effective and economical. None of these previous efforts, however, provides the benefits attendant with the present invention. Additionally, prior connectors and contacts do not suggest the present inventive combination of method steps and component elements arranged and configured as disclosed and claimed herein. The present invention achieves its intended purposes, objects and advantages over the prior art devices through a new, useful and unobvious combination of method steps and component elements, with the use of a negligible number of functioning parts, at a reasonable cost to manufacture, and by employing only readily available materials.

It is therefore an object of the present invention to provide an electrical contact for use in a connector adapted to be attached to a mother printed circuit board and adapted to removably receive a daughter printed circuit board of the edge card type for mechanically and electrically coupling the mother and daughter printed circuit boards, the connector being of the type formed of an electrically insulating housing with a plurality of electrically conductive contacts extending therethrough for removably receiving the daughter printed circuit board, each contact including a first portion formed as a solder tail positionable to extend from the housing for coupling with the mother printed circuit board; a second portion extending from the solder tail at an angle for contacting and supporting a received daughter printed circuit board; and a third portion extending from the second portion at an angle to define, at the bight of the second and third portions, a contacting portion of curved configuration on the front face of the contact extending outwardly with respect to the rear face of the contact, with the contacting portion located for contacting the electrical conductive traces on the edge of a received daughter printed circuit board.

It is a further object of the invention to provide a method of fabricating an electrical contact comprising the steps of providing an elongated strip of electrically conductive material with a lower portion and an upper portion; coining the strip at an intermediate contact portion between the lower and upper portions and bending of the piece at the intermediate contact portion to form a bight with a radially interior face and a radially exterior face, the coined portion being on the radially exterior face for contacting a component to be electricaly coupled with the contact.

It is yet a further object of this invention to miniaturize electrical connectors and their contacts.

Still a further object of the invention is to maintain a high, constant stress between electrical contacts of connectors and the contacted electrical components.

An additional object of the invention is to precisely align electrical contacts of connectors during their contact with an electrical component.

Lastly, it is an object of the present invention to fabricate an electrical contact with a compound radii contact area (which may be generally spherical) on the exterior face of a bend through coining and bending.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an electrical contact for use in a connector adapted to be attached to a mother printed circuit board and adapted to removably receive a daughter printed circuit board of the edge card type for mechanically and electrically coupling the mother and daughter printed circuit boards, the connector being of the type formed of an electrically insulating housing with a plurality of electrically conductive contacts extending therethrough for removably receiving the daughter printed circuit board. Each contact includes a first portion formed as a solder tail positionable to extend from the housing for coupling with the mother printed circuit board; a second portion extending from the solder tail at an angle for contacting and supporting a received daughter printed circuit board; and a third portion extending from the second portion at an angle to define, at the bight of the second and third portions, a contacting portion of curved configuration on the front face of the contact extending outwardly with respect to the rear face of the contact, with the contacting portion located for contacting the electrical conductive traces on the edge of a received daughter printed circuit board. The contact may be fabricated of phosphor bronze and plated with nickel to a thickness of about between 0.000050 and 0.000150 inches. The contacting portion may be plated with about 40 microinches or thicker PdNi flashed with gold to a thickness of about 0.000004 inches nominally. In the alternative, the strip may be plated with about 30 microinches thick or thicker of gold. The first portion is plated with solder of about 60 percent tin and 40 percent lead to a thickness of about between 0.000100 and 0.000500 inches.

The invention may also be incorporated into a connector adapted to be attached to a mother printed circuit board and to removably receive a daughter printed circuit board of the edge card type and adapted to mechanically and electrically couple the mother and daughter printed circuit boards. The connector comprises an electrically insulating housing; and a plurality of electrically conductive contacts extending through the housing in rows of spaced pairs of removably receiving an edge of a daughter printed circuit board in a central plane between the rows, each contact including a lower section formed as a solder tail positionable to depend from the housing for coupling with the mother printed circuit board; an intermediate section extending upwardly from the solder tail and inwardly toward the central plane for supporting a received daughter printed circuit board; and an upper section extending upwardly and outwardly to define, at the bight of the upper and intermediate sections, a contact area of compound radii (generally spherical) configuration on the radially exterior face of the bight bowed outwardly with respect to the radially interior face of the bight, with the contact area of each pair of contacts facing toward each other for contacting the traces on the edge of a received daughter printed circuit board. The bight has a radius of curvature of about between 0.067 and 0.061 inches. The bow of the contact has a radius of curvature of about between 0.012 and 0.018 inches. The contact has a cross-sectional configuration which is generally rectangular except in the contact portion whereat it has generally parallel side edges and a back face perpendicular with respect to the side edges and a front face bowed outwardly from the back face. The front face extends outwardly from the side edges about between 0.003 and 0.005 inches. The center lines of the contact pairs are about 0.050 inches apart. The contact pairs are located with respect to each other at about 20 pairs per linear inch.

Lastly, the invention may be incorporated into a method of fabricating an electrical contact comprising the steps of: providing an elongated strip of electrically conductive material with a lower portion and an upper portion; coining the strip at an intermediate contact portion between the lower and upper portions and bending of the piece at the intermediate contact portion to form a bight with a radially interior face and a radially exterior face, the coined portion being on the radially exterior face for contacting a component to be electrically coupled with the contact. The method further includes the step of fabricating the contact of phosphor bronze. The method further includes the step of plating the contact with nickel to a thickness of about between 0.000050 and 0.000150 inches. The method further includes the step of plating the lower portion of the contact with solder of about 60 percent tin and 40 percent lead to a thickness of about between 0.000100 and 0.000500 inches. The method further includes the step of plating the contact portion of the contact with about 40 microinches thick or thicker of PdNi flashed with gold to a thickness of about 0.000004 inches nominally.

The foregoing has outlined rather broadly some of the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several drawings.

DETAILED DESCRIPTION OF THE INVENTION

Figure 7:
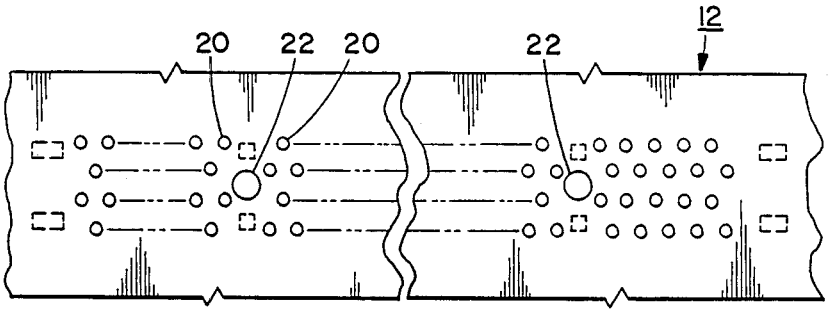
FIG. 7 is a plan view of a portion of the mother printed circuit board to which the connector of the present invention may be coupled.
Figure 8:
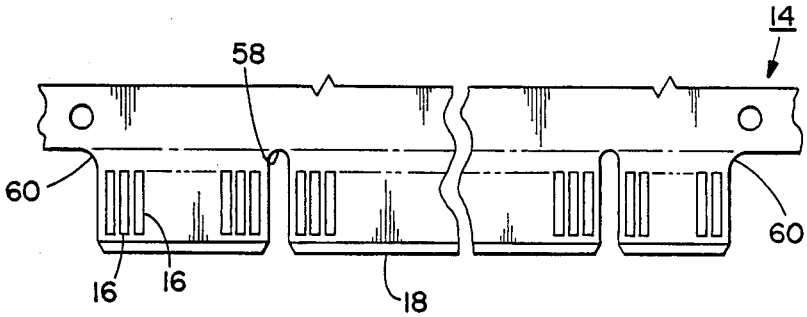
FIG. 8 is a front elevational view of a portion of the daughter printed circuit board of the edge card type adapted to be received by the connector of the present invention.

Shown in the various Figures is an edge card connector 10 adapted to couple a mother printed circuit board 12 with a daughter printed circuit board 14 of the edge card type. Board 14 has contact traces 16 along one edge 18. A portion of a typical mother printed circuit board is shown in FIG. 7 while a typical edge card type daughter printed circuit board is shown in FIG. 8. For the sake of illustration only, the mother printed circuit board is shown with apertures 20 at the ends of its electrical traces for receiving the coupled electrical element such as the connector of the present invention. Enlarged apertures 22 and 22*a* are also included for mechanically attaching the connector 10 with the board 12. It should be understood, however, that a surface mount connection with soldering could be utilized for the coupling between connector and board. A portion of the daughter printed circuit board 14 is illustrated in FIG. 8 with aligned parallel contacts 16 shown. This is that portion of the daughter board adapted to be releasably coupled with the connector 10 of the instant invention whereby the individual traces 16 may be coupled with the individual contacts of the connector for coupling the mother and daughter printed circuit boards 12 and 14.

The connector 10 is comprised of two basic components, an electrically insulating housing 26 and the plurality of electrically conductive contacts 28. The contacts function to transmit electrical current, either signals or power, between the upper edge 30 adjacent to the daughter board and the lower edge 32 adjacent to the mother board. The housing provides support between the electrical components being coupled and supports the individual contacts in the proper electrically isolated position, with respect to each other.

Figure 1:
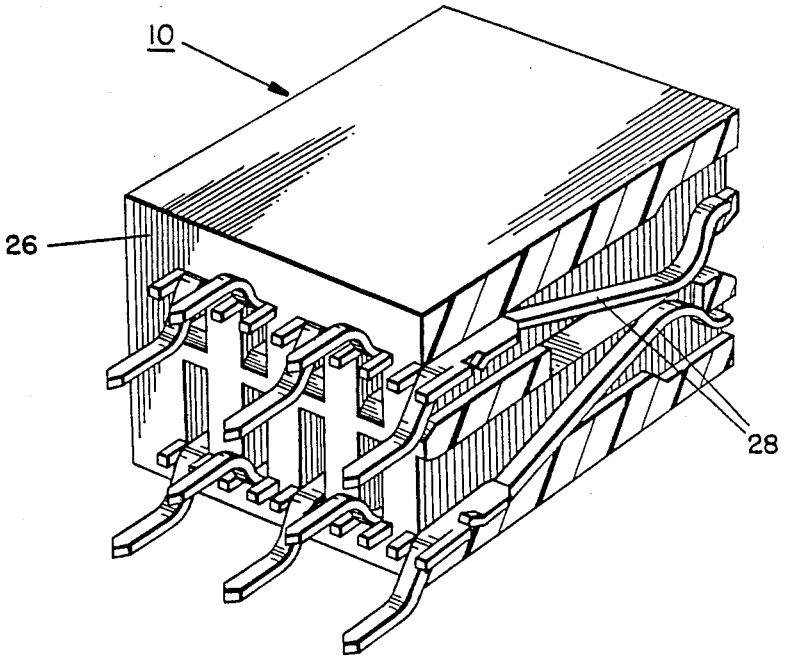
FIG. 1 is an enlarged partial perspective illustration of the connector constructed in accordance with the present invention with parts removed to show certain internal constructions thereof.
Figure 2:
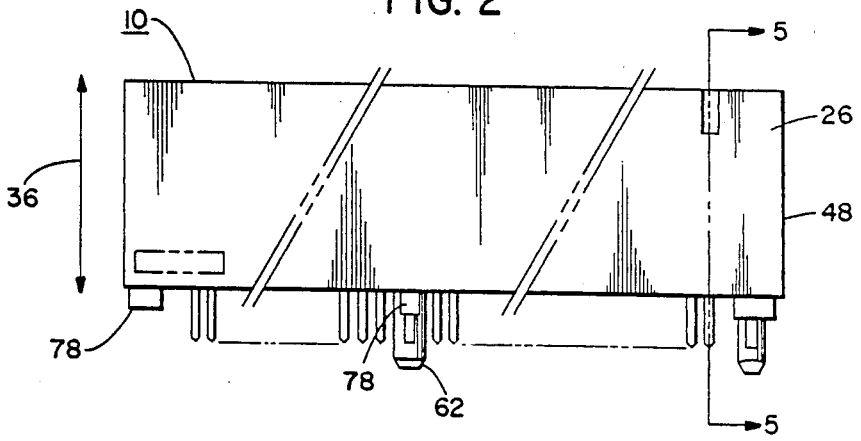
FIG. 2 is a front elevational view of the connector shown in FIG. 1.
Figure 4:
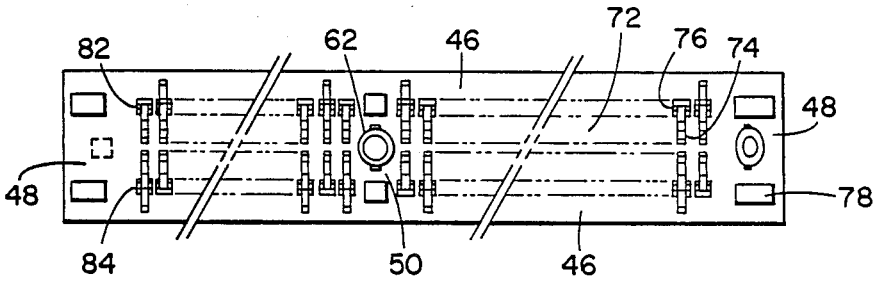
FIG. 4 is a bottom view of the connector shown in FIG. 2.

The housing is a generally rectangular member molded of a conventional electrical insulator such as Ryton R-4, Ryton R-7, or Ryton R-404. Ryton is a trademark of the Phillips 66 Company of Pasadena, Tex. It is of an extended length 34 largely determined by the number of contacts to be supported. Its height 36, through the majority of its extent, is slightly less than the lengths of the supported contacts. Its thickness 38 is relatively thin, being merely sufficient to retain the two rows of opposed contacts with a space 42 therebetween for receiving the daughter board 14 (note the cross-sectional configuration of FIG. 5). The majority of the bulk of each housing is comprised of essentially parallel side walls 46 extending the entire length of the housing and connector. End walls 48, formed integrally at the ends of the side walls, couple the side walls and are of sufficient thickness to add rigidity to the housing. One or more intermediate walls 50 may be spaced periodically along the length of the side walls parallel with the end walls for further rigidity. The side walls and intermediate walls have upper edges 54 and 56 while the daughter printed circuit board has recesses 58 and 60. The asymmetric location of the intermediate wall 50 and intermediate cutout 58 precludes the improper locating of the daughter printed circuit board into the housing. Depending projections or posts 62 and 62*a* extent downwardly from the intermediate and end walls for providing a mechanical coupling with the mother circuit board. The posts may be provided with different characteristics for proper orientation with the circuit board. For instance, the diameters of posts 62 and 62*a* can be different, as shown in FIG. 2, to provide proper orientation to the circuit board. Also, the shape of posts 62 and 62*a* can be different, as shown in FIG. 4, for the same purpose.

A pair of parallel upper bearing strips or shelves 64 extend from end wall to end wall of the housing. Spacer bars 66 are periodically located between the shelves 64 and their associated side walls 46 to define apertures 68 for receiving the upper edge portions of the individual contacts 28. The upper interior edges of the support bars are beveled for guiding the lower edge of a daughter printed circuit board into the slot. The lower face of the housing is also provided with a longitudinal support bar 72 and spacer bars 74 defining apertures 76 for separating the lower edges of the individual contacts.

Standoffs 78 are formed into the lower face of the connector housing to maintain the housing a predetermined distance from the mother printed circuit board for functioning as a washway to allow the flow of fluid therefrom as is necessary during the soldering of the solder tails to the mother printed circuit board.

Figure 5:
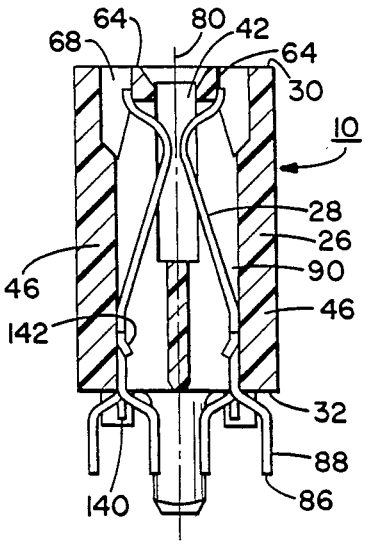
FIG. 5 is a sectional view of the connector shown in FIG. 2 taken along line 5—5.
Figure 6:
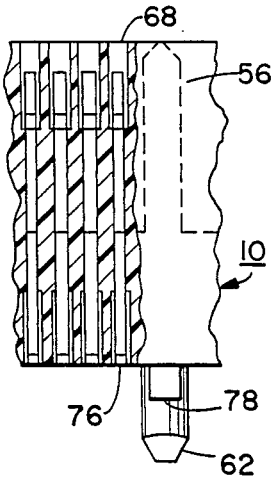
FIG. 6 is a partially fragmented view of a portion of the connector housing shown in FIG. 2.

A vertical central plane 80, shown in FIG. 5, separates the connector including the housing and the rows of contacts into two essentially symmetric halves. Further, the use of a vertical central plane and the illustration of an upstanding connector and daughter printed circuit board in combination with a horizontal mother circuit board are done for descriptive purposes only. It should be understood that the present invention could be practiced at virtually any angular, planar orientation with respect to the horizontal or vertical.

Supported within the housing are a plurality of individual electrical contacts. The contacts are arranged in two essentially parallel rows 82 and 84 generally symmetric about a vertical central plane 80. The lower ends 86 of each opposed pair terminate in solder tails 88. The solder tails of each pair are offset from the solder tails of each adjacent pair (note FIG. 4). The solder tails are adapted to be coupled with the electrical traces of the mother printed circuit board through apertures 20. As shown in FIG. 7, the through-hole technique is disclosed herein. It should be appreciated, however, that surface mount couplings could just as easily have been utilized.

Figure 3:
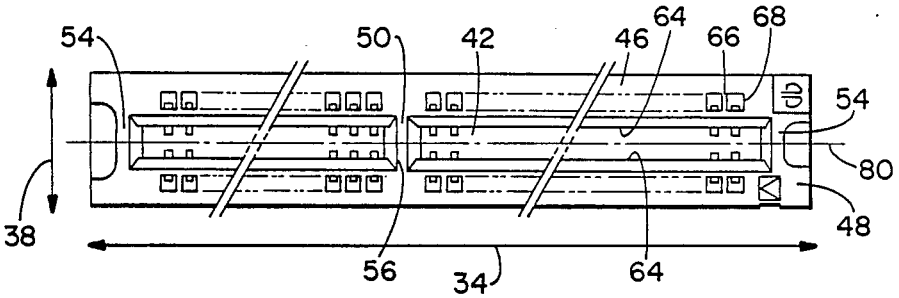
FIG. 3 is a top plan view of the connector shown in FIG. 2.

The solder tails extend upwardly into the housing (see FIG. 5) where they have angled intermediate sections 90 bending toward the central plane 80 and then outwardly therefrom. At the area where the terminals bend inwardly then outwardly, there is a contact area or section 96 constituting a bight in the connector for making mechanical as well as electrical contact with the traces of the daughter printed circuit board 14. Above this region, the contacts extend upwardly where the uppermost parts 98 are received in their individual apertures 68 defined by the side walls 46, shelves 64 and spacer bars 66, as shown in FIG. 3. The individual contacts at their upper ends 94 are constrained from lateral movement by the spacer bars 66. The spacer bars 66 limit the degree of lateral movement of the upper ends of the contacts as during the insertion of the daughter printed circuit board cards into the connector as well as during their removal therefrom. The individual contacts are effectively spring loaded within the housing against the shelves 64 limiting the movement of adjacent contacts of each pair toward each other.

Figure 9:
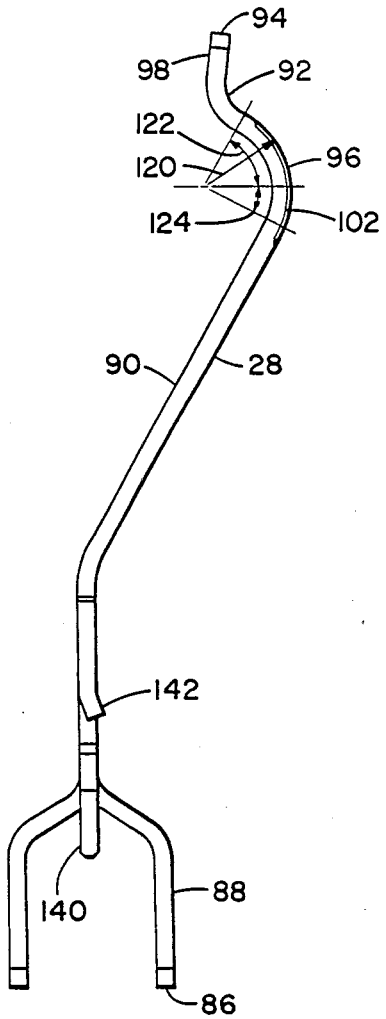
FIG. 9 is a side elevational view of one of the contacts shown in the connector of FIGS. 1 through 6.
Figure 10:
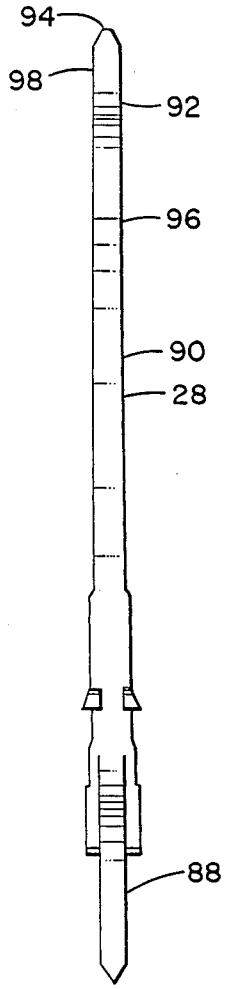
FIG. 10 is a front elevational view of the contact shown in FIG. 9.
Figure 11:
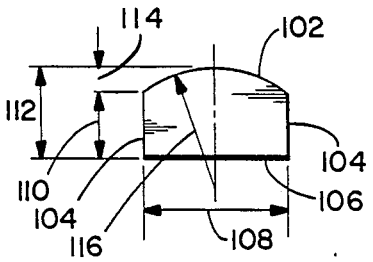
FIG. 11 is a sectional view of the contact shown in FIGS. 9 and 10 taken through the coined area.
Figure 12:
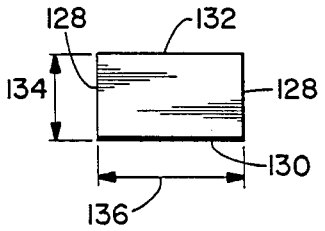
FIG. 12 is a sectional view of the contact shown in FIGS. 9 and 10 but taken on either side of the coined area.

The proper contact stress is thus provided by a combination of the crown on the contact area with a radius of curvature as seen in FIG. 11 and the curve on the contact area with a radius of curvature as seen in FIG. 9, the area where the traces 16 rest when inserted. The crown is formed by coining and bending the contact strips in the contact area. The radius then has a plating placed on it such as a gold. The crown and the curve jointly provide a combination of two radii or compound radii which produce the proper stress when the contact is placed on the traces 16 of the daughter printed circuit board 14. The gold is used on the contact primarily for lubrication.

The contacts are placed in the housing 26 and assume a free state. The contacts are then placed in their confining apertures 68 as shown in FIG. 5 whereby they are pre-stressed by hooking behind the shelves 64. The contacts then are further stressed when the daughter printed circuit board 14 is inserted so that their upper ends 94 move off the shelves thereby placing the proper amount of stress of about 200,000 psi, plus or minus 50,000 psi, on the traces 16 of the printed circuit board. Tests have shown that the daughter printed circuit board may be inserted and removed a hundred times without degrading performance of the contact, that is, the contact resistance will not degrade more than 10 milliohms over the hundred insertions and removals. When the printed circuit board 14 is inserted, deformation occurs on the contact and traces to produce the proper contact. The modulus of elasticity and the poissons ratio are considered when calculating the proper stress. In this case, the modulus of elasticity is about 16 million psi and the poissons ration is about 0.3.

The cross-sectional configuration of each contact is essentially rectangular at any point along its length except in the contact zone where an electrical contact is made with the traces of the daughter printed circuit board. In this zone, the opposed radially exterior faces 102 of each contact assume a convex configuration (note FIG. 11). This configuration is achieved through coining the contacts in this region rather than simply stamping them as had been the custom of the trade. The cross section has approximately parallel side edges 104 and a perpendicular radially interior face 106. The bowed exterior face 102 extends outwardly from the edges 104.

The individual contacts are fabricated of any conventional spring material such as metal, preferably phosphor bronze. Each contact is plated with nickel to a thickness of about between 0.000050 and 0.000150 inches. The solder tails are coated with solder of about 60 parts tin and 40 parts lead to a thickness of about between 0.000100 and 0.000500 inches. In the contact area a coating of gold at about 0.000004 inches nominally is plated over about 0.000040 inches minimum of about 80 parts palladium and 20 parts nickel. All of the platings include the plating of all surfaces or sides except in the contact area wherein the plating need only occur on that surface to contact the daughter printed circuit board.

The individual contacts are about 0.024 to 0.026 inches in width 108 being received at the lower part of the housing in apertures 76 of about 0.033 and 0.034 inches with the upper apertures 68 being about between 0.028 and 0.032 inches. The individual contacts are of a constant rectangular thickness 110 with a maximum total height 112, a rise of 114 and a radius of curvature 116.

In the contact zone, the surface of the contact bends about a radius of curvature 120 between 0.061 and 0.067 inches. From the point of contact, the curved surface of the contact area extends downwardly between 35 and 36 degrees at 122 and, upwardly, about 49 degrees at 124. The curved surface of the contact area rises above the upper edge to form a bulge of about 0.003 and 0.005 inches above the adjacent edges. This constitutes a radius of curvature 116 of about between 0.012 and 0.018 inches.

The contact on opposite sides of the coined area has side edges 128, a lower face 130 and an upper face 132. During the coining process, the width 136 of the strip metal is increased from about 0.018 to about 0.022 inches. Compare the width 136 to 108. However, the overall height is generally not changed and the overall height after coining is essentially or approximately the same as prior to coining.

The use of a concentrated contact area is desired because it produces a higher contact stress by reducing the area which contacts the trace. This stress is needed to break through any surface film or other debris that may be on the pad. The stress required is approximately 200,000 psi plus or minus 50,000 psi.

Creating a concentrated contact area in this fashion has in the past proved to be very difficult to do in a precisely controlled manner. If a spherical dimple is put on the contact leg first, then the subsequent bending of the leg will cause distortion in the contact area. Such distortion eliminates any control over the shape of the contact area and places on the surface an orange peel effect which is not as smooth as required. On the other hand, if the bend is put in first, then it is hard to make certain that a spherical dimple ends up at the intended location. It would thus be different to have the spherical dimple aligned in the center of the contact. When employing other than the method of the present invention, the spherical area may be so far out of center that it interferes with, and breaks through, the edge of the contact. These problems are amplified in connectors where the contacts are on the miniaturized 0.050 center lines as disclosed herein.

The solution to the problem is to place the high stress configuration on the contact by forming the bend in the contact and coining during manufacturing, resulting in the desired compound surface.

The method of fabricating the electrical contact thus comprises the steps of initially providing an elongated strip of electrically conductive material stamped from a sheet with a lower portion and an upper portion. The strip is then deformed by coining at an intermediate contact area between the lower and upper portions. The strip is bent at the intermediate contact area to form a bight with a radially interior face and a radially exterior face. The coined area is on the radially exterior face of the bent strip for contacting a trace 16 of the daughter board to be electrically coupled with the contact.

The method further includes the step of fabricating the contact of phosphor bronze and plating the strip with nickel to a thickness of about between 0.000050 and 0.000150 inches. The method further includes the step of plating the lower portion of the contact with solder of about 60 percent tin and 40 percent lead to a thickness of about between 0.000100 and 0.000500 inches to ensure a proper soldering contact with the mother board. Lastly, the contact area of the contact is plated with about 40 microinches or thicker PdNi flashed with gold to a thickness of about 0.000004 inches nominally. Alternatively, the area can be plated with about 30 microinches or thicker gold.

What had to be done differently from the prior design and fabrication of the miniaturized 0.050 inch contact array as disclosed herein was to redesign the radius and the crown with certain stringent requirements to make the system operable. The resulting area of contact that is produced between the contact strip and the daughter board traces is approximately elliptical in shape. The resulting area within the ellipse is controlled and reproducible. Because of the closeness of the contacts and their relatively reduced widths compared to the prior art devices, it was difficult to avoid the possibility of cross-connections and arcing in the area of contact. The locating posts 62, as discussed hereinabove, assists the housing to assure that a proper alignment takes place over such tight spacing.

The present disclosure includes that information contained in the appended claims as well as that in the foregoing description. Although the invention has been described in its preferred form or embodiment with a certain degree of particularity, it is understood that the present disclosure of the preferred form has been made only by way of example and that numerous changes in the details of construction, fabrication and use, including the combination and arrangement of parts, may be resorted to without departing from the spirit and scope of the invention.

What is claimed is:

1. An electrical contact for use in a connector adapted to be attached to a mother printed circuit board and adapted to removably receive a daughter printed circuit board of the edge card type for mechanically and electrically coupling the mother and daughter printed circuit boards, the connector being of the type formed of an electrically insulating housing with a plurality of electrically conductive contacts extending therethrough for removably receiving the daughter printed circuit board, each contact including:

a first portion formed as a solder tail positionable to extend from the housing for coupling with the mother printed circuit board;

a second portion extending from the solder tail at an angle; and a third portion extending from the second portion at an angle and having a bight therebetween for contacting and supporting a received daughter printed circuit board, the bight having a contacting portion on the front face of the contact, the contacting portion being formed from the curve of the bight and the front face of the contact being non-flat and extending outwardly with respect to the rear face of the contact, whereby the contacting portion includes a compound radii with the contacting portion located for contacting the electrical conductive traces on the edge of a received daughter printed circuit board.

2. The contact as set forth in claim 1 wherein the contact is fabricated of phosphor bronze.

3. The contact as set forth in claim 2 wherein the contact is plated with nickel to a thickness of about between 0.000050 and 0.000150 inches.

4. The contact as set forth in claim 3 wherein the contacting portion is plated about 40 microinches or thicker PdNi flashed with gold to a thickness of about 0.000004 inches nominally.

5. The contact as set forth in claim 4 wherein the first portion is plated with solder of about 60 percent tin and 40 percent lead to a thickness of about between 0.000100 and 0.000500 inches.

6. The contact as set forth in claim 3 wherein the contacting portion is plated with about 30 microinches thick or thicker of gold.

7. A connector adapted to be attached to a mother printed circuit board and to removably receive a daughter printed circuit board of the edge card type and adapted to mechanically and electrically couple the mother and daughter printed circuit boards, the connector comprising:

an electrically insulating housing; and a plurality of electrically conductive contacts extending through the housing in rows of spaced pairs for removably receiving an edge of a daughter printed circuit board in a central plane between the rows, each contact including a lower section formed as a solder tail positionable to depend from the housing for coupling with the mother printed circuit board; an intermediate section extending upwardly from the solder tail and inwardly toward the central plane for supporting a received daughter printed circuit board; and an upper section extending upwardly and outwardly to define, at the bight of the upper and intermediate sections, a contact area of compound radii configuration on the radially exterior face of the bight bowed outwardly with respect to the radially interior face of the bight, with the contact area of each pair of contacts facing toward each other for contacting the traces on the edge of a received daughter printed circuit board.

8. The connector as set forth in claim 7 wherein the bight has a radius of curvature of about between 0.067 and 0.061 inches.

9. The connector as set forth in claim 7 wherein the bow of the contact has a radius of curvature of about between 0.012 and 0.018 inches.

10. The connector as set forth in claim 7 wherein the contact has a cross-sectional configuration which is generally rectangular except in the contact portion whereat it has generally parallel side edges and a back face perpendicular with respect to the side edges and a front face bowed outwardly from the back face.

11. The connector as set forth in claim 10 wherein the front face extends outwardly from the side edges about between 0.003 and 0.005 inches.

12. The connector as set forth in claim 7 wherein the center lines of the contact pairs are about 0.050 inches apart.

13. The connector as set forth in claim 7 wherein the contact pairs are located with respect to each other at about 20 pairs per linear inch.

14. The connector as set forth in claim 7 having at least two locating post means extending from the exterior of the housing of different characteristics so that when installed onto a mating part, the connector can be installed only in the proper orientation with the mating part.

15. An electrical contact for use in a connector adapted to be attached to a mother printed circuitry board and adapted to removably receive a daughter printed circuit board of the edge card type for mechanically and electrically coupling the mother and daughter printed circuit boards, the connector being of the type formed of an electrically insulating housing with a plurality of electrically conductive contacts extending therethrough for removably receiving the daughter printed circuit board, each contact comprising:

a first portion formed as a solder tail positionable to extend from the housing for coupling with the mother printed circuit board;

a second portion extending from the solder tail at an angle; and a third portion extending from the second portion, the third portion having a concentrated contact area for contacting and supporting a received daughter printed circuit board, the contact area including a crown on the front face of the contact and a curve of the contact along the contact area whereby the crown and the curve provide a reduced contact area to provide an increased contact stress.

* * * * *

UNITED STATES PATENT AND TRADEMARK OFFICE

CERTIFICATE OF CORRECTION

PATENT NO. : 4,846,734

DATED : July 11, 1989

INVENTOR(S) : Thomas C. Lytle

It is certified that error appears in the above-identified patent and that said Letters Patent is hereby corrected as shown below:

In The Drawings:

Figure 9 should appear as shown on the attached sheet.

Signed and Sealed this

Tenth Day of July, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,846,734

DATED : July 11, 1989

INVENTOR(S) : Thomas C. Lytle

It is certified that error appears in the above—identified patent and that said Letters Patent is hereby corrected as shown below:

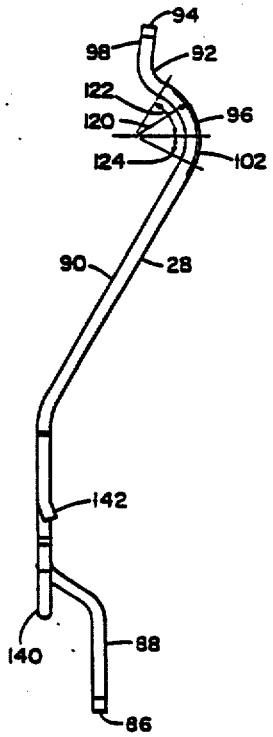

FIG. 9